United States Patent [19]

Young

[11] Patent Number: 4,614,900

[45] Date of Patent: Sep. 30, 1986

[54] REMOTE CONTROLLED DRIVING SYSTEM FOR A BOAT

[76] Inventor: Joseph C. Young, 1390 Devonshire Dr., Montgomery, Ala. 36116

[21] Appl. No.: 730,070

[22] Filed: May 3, 1985

[51] Int. Cl.[4] ..... B63H 21/26

[52] U.S. Cl. ..... 318/16; 114/144 R; 114/144 RE

[58] Field of Search ..... 318/16; 440/6, 7; 114/144 A, 144 R, 144 RE, 255

[56] References Cited

U.S. PATENT DOCUMENTS

| | | | |
|---|---|---|---|
| 2,079,871 | 5/1937 | Price | 310/66 X |
| 2,877,733 | 3/1959 | Harris | 440/7 |
| 3,598,947 | 8/1971 | Osborn | 440/7 X |
| 3,980,039 | 9/1976 | Henning | 440/6 |
| 4,066,032 | 1/1978 | Travis | 440/6 |
| 4,151,807 | 5/1979 | Black, Jr. | 440/6 X |

*Primary Examiner*—William M. Shoop, Jr.
*Assistant Examiner*—Bentsu Ro
*Attorney, Agent, or Firm*—Newton, Hopkins & Ormsby

[57] ABSTRACT

An electric trolling motor is remotely controlled by a hand held or foot operated radiant energy transmitter coacting with a receiver, the trolling motor and a turning or directional motor connected through gearing with a trolling motor support shaft. The trolling motor can operate in a straightaway propulsion mode or in left hand or right hand directional turning modes, all remotely controlled. The fisherman is free to occupy the bow of the boat during fishing activities while remotely controlling the trolling motor at the stern.

14 Claims, 5 Drawing Figures

REMOTE CONTROLLED DRIVING SYSTEM FOR A BOAT

BACKGROUND OF THE INVENTION

Trolling motor for small fishing boats directly controlled by human operators in the bow or stern of the boat are well known and widely used. Such manual control of the trolling motor occupies the hands of the fisherman or another occupant of the boat and also confines the fisherman or occupant at or near the trolling motor.

The objective of the present invention is to provide a simple and convenient remote control arrangement for an electric trolling motor which frees the fisherman to occupy any location in or close to the boat and attend to fishing activities while remotely controlling the operation of the electric trolling motor by means of a hand held or foot operated radio transmitter, which coacts with a radio receiver and trolling motor propulsion and directional control means forming a part of an integrated trolling motor assembly.

More particularly, in accordance with the invention, the trolling motor can be operated under remote control from any location of the boat in a straightaway propulsion mode or in a directional or turning mode through a rotational servo motor and gearing connected through slip rings and brushes to a control circuit which includes the radio receiver. The electrical drive system for the trolling motor is battery powered and power requirements for the receiver and small rotational motor are so low that they will not substantially reduce the running time of the system before the storage battery will normally require recharging. Radio signal transmission power and frequency can be controlled to prevent possible interference with similar trolling systems in close proximity.

The invention is simplified in construction, compact, convenient to operate and sufficiently durable to assure a long useful life with normal care.

Other features and advantages of the invention will become apparent to those skilled in the art during the course of the following description.

DETAILED DESCRIPTION

Figures 1, 2:
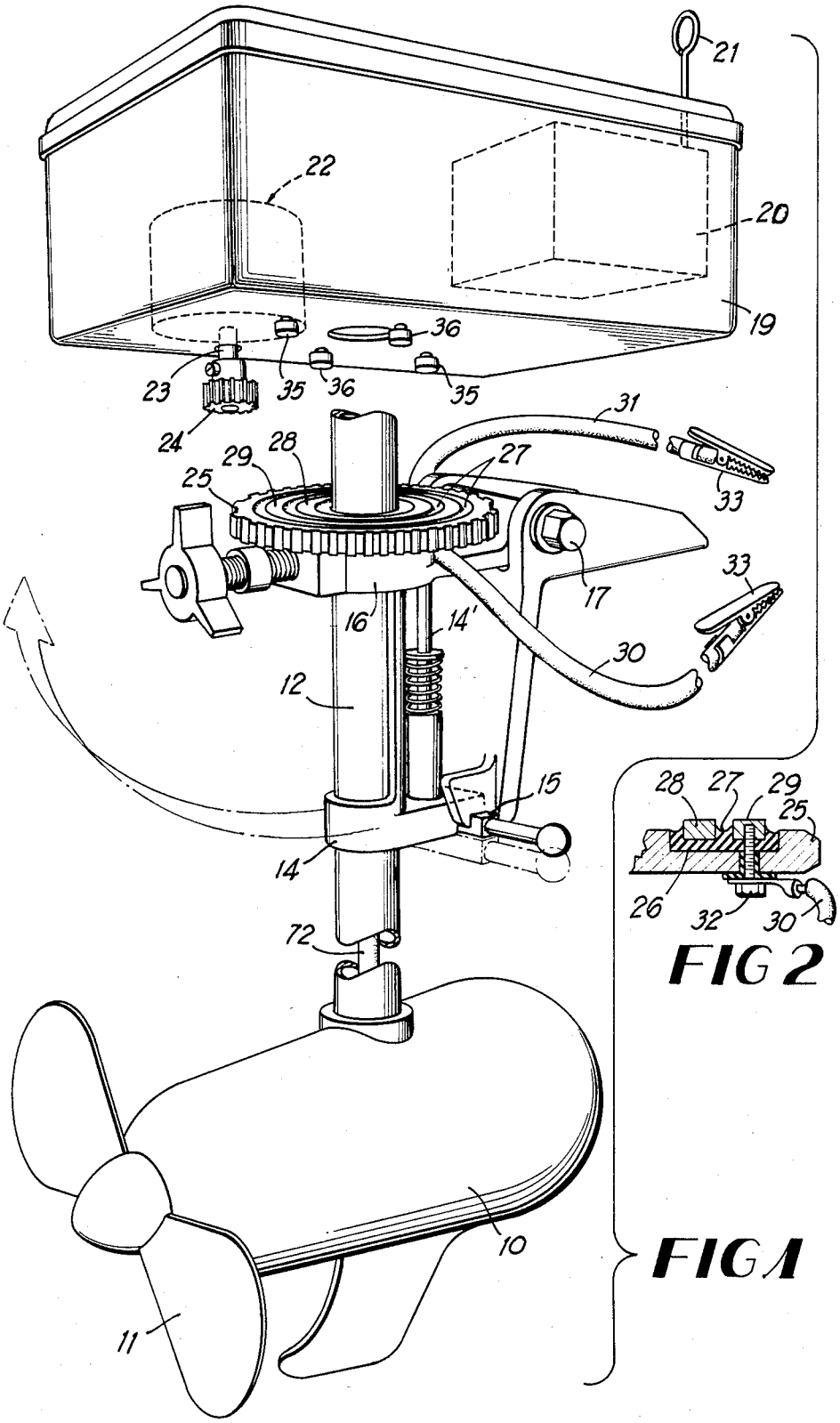
FIG. 1 is an exploded perspective view of a remote controlled driving system for a boat according to the present invention.
FIG. 2 is a fragmentary vertical section taken through a driving system directional turning gear and slip ring arrangement.

Referring to the drawings in detail, wherein like numerals designate like parts, the driving system includes a main electric trolling motor 10 which rotates a propulsion propeller, the trolling motor 10 being secured to and bodily carried by the lower end of a vertically disposed tubular shaft 12.

An L shaped mounting bracket 13 for the trolling motor system is for mounting to a boat (not shown) near or at its bow or stern. A traverse bolt 17 protruding across the bracket 13, pivotally carries a shaft cradle which includes an upper collar 16 which protrudes outwardly from traverse bolt 17. The cradle also includes a support member 14' protruding downwardly from upper collar 16 and supports at its lower end, a lower collar 14 aligned with and spaced from and below the upper collar 16. The usual spring loaded latch member 15 latches the cradle in a vertical position against bracket 13, and when latch member 15 is moved downwardly to its broken line position, in FIG. 1, it unlatches, permitting the cradle to be manually moved from its vertical position, upwardly in an arc pivoting about traverse bolt 17. When the cradle is returned to its vertical position, the latch member 15 automatically latches the cradle in place.

Fixed to the upper end portion of shaft 12, above the upper collar 16, is a housing 19 which is rotated with the shaft 12. A radio receiver 20 is disposed within the housing 19, the receiver having an antenna 21 mounted on the upper surface of housing 19 and protruding upwardly therefrom.

Also mounted within the housing 19 is a reversible steering motor 22, having a downwardly extending drive shaft or output shaft 23, protruding outwardly below the housing 19. The output shaft 23 is at spaced radials from and parallel to support shaft 12. Below housing 19, shaft 23 is provided with a spur gear or drive sprocket 24. Mounted in a fixed position on the upper surface of upper collar 16 is a relatively larger horizontally disposed circular gear or pinion 25, the axis of which is concentric with support shaft 12.

Figure 5:
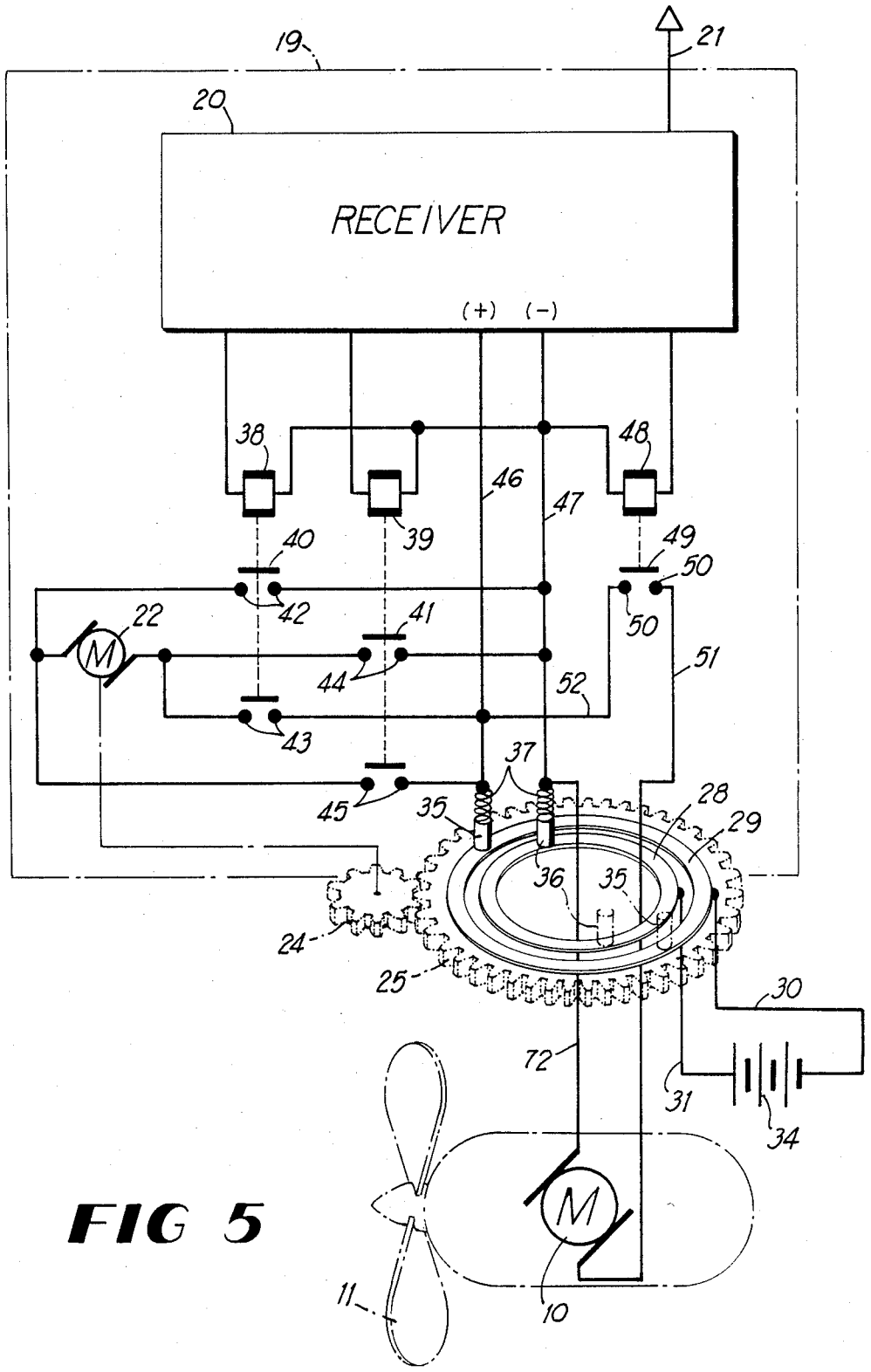
FIG. 5 is a schematic view of the trolling motor, steering motor, receiver and associated circuitry employed in the invention.

The gear or sprocket 24 meshes, as shown in FIG. 5, with the gear or pinion 25. Thus, by rotating steering motor 22 in one direction or the other, gear 24 is rotated accordingly to travel around the periphery of gear or pinion 25, thereby moving housing 19 and shaft 12 for establishing the radial portion of the trolling motor 10. This, in turn, allows a boat equipped with the invention to be directionally steered, right or left, in the water by remote control, since the housing 19, shaft 12 and motor 10 are freely rotatable about the vertical axis through 360° left or right.

The gear 25 has a recess 26 (see FIG. 2) in its top face and concentrically receives an annular dielectric insulating material 27 which is held by a pair of radially spaced, fixed concentric slip rings 28 and 29. Storage battery cables 30 and 31 are respectively electrically connected with the slip rings 29 and 28, in the manner shown in FIG. 5. Cables 30 and 31 are respectively connected by a terminal, such as screw 32 with the slip rings 28 and 29 and such screws are insulated from the gear 25, as shown in FIG. 2. The battery cables 30 and 31 carry alligator clips 33 adapted for connection with the two terminals of a suitable storage battery 34, FIG. 5, such as a 12 volt DC battery.

Contact brushes 35 and 36, carried by housing 19, are biased by springs 37 into conducting sliding engagement with the outside and inside rings 29 and 28. Left turn and right turn relays 38 and 39 receive signals from the receiver 20 to activate associated left turn and right turn relay switches 40 and 41, the contacts of these two switches being electrically connected through pairs of terminals 42, 43, 44 and 45 with the directional or steering motor 22, as shown in FIG. 5. The same switch terminals are further connected electrically through conductors 46 and 47 with the brushes 35 and 36 and with corresponding electrical terminals of the receiver 20.

Similarly, an on-off relay 48 for the trolling motor 10 receives a signal from the receiver 20 to operate an on-off relay switch 49 through switch contacts 50, one of which contacts is connected through a conductor 51 with a terminal of the trolling motor 10 and the other switch contact 50 is connected through a conductor 52 and terminals 43 with a terminal of the steering motor 22.

Figure 3:
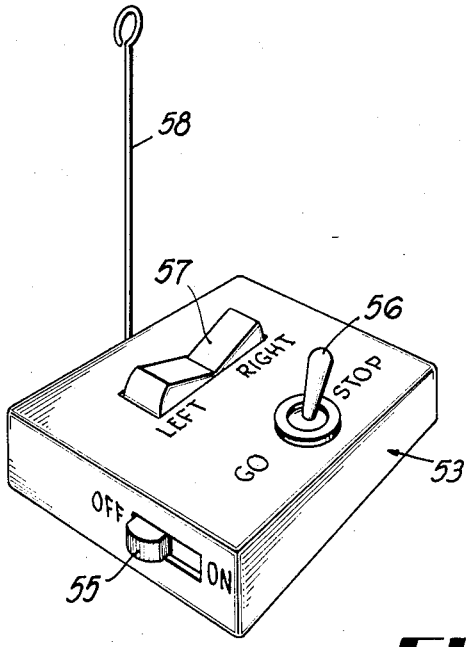
FIG. 3 is a perspective view of a hand held transmitter used in one operational mode of the invention.

The trolling motor 10 of the steering system can be operated remotely in two modes, as by a fisherman in any location of a boat. In one mode of operation, a small hand held radio transmitter 53, FIG. 3, is employed, and in a second mode of operation a foot operated transmitter 54 is employed. The hand held transmitter 53 which contains a 9 volt DC battery includes a power on-off switch 55, another on-off switch 56 for the remotely controlled trolling motor 10 and a left turn and right turn switch 57. The transmitter 53 is tuned to the frequency of receiver 20 and further includes an antenna 58 matched with the receiver antenna 21.

The foot operated transmitter 54 has an anti-skid tread pad 59 covering its bottom face, a power on-off switch 60 connected with the internal 9 volt battery of the transmitter and a matched antenna 61. Additionally, a foot treadle 62 preferably equipped with an adjustable foot strap 63 is held near its rear end on a universal swivel mount 64. Near its forward end, the foot treadle is connected to a depressable trolling motor on-off switch actuator 65, biased to an off position by a spring 66. A side-to-side swinging actuator rod 67 on the swivel mount can engage selectively actuators 68 and 69 of left turn and right turn switches 40 and 41. The dual actuator 57 shown in FIG. 3 serves the same purpose in actuating selectively the left turn and right turn switches 40 and 41, FIG. 5. The foot treadle is swung vertically by the foot of the user on the cross axis element 70 of the universal swivel 64, and the foot treadle is swung horizontally with the actuator rod 67 on the vertical axis of the universal swivel 64.

Figure 4:
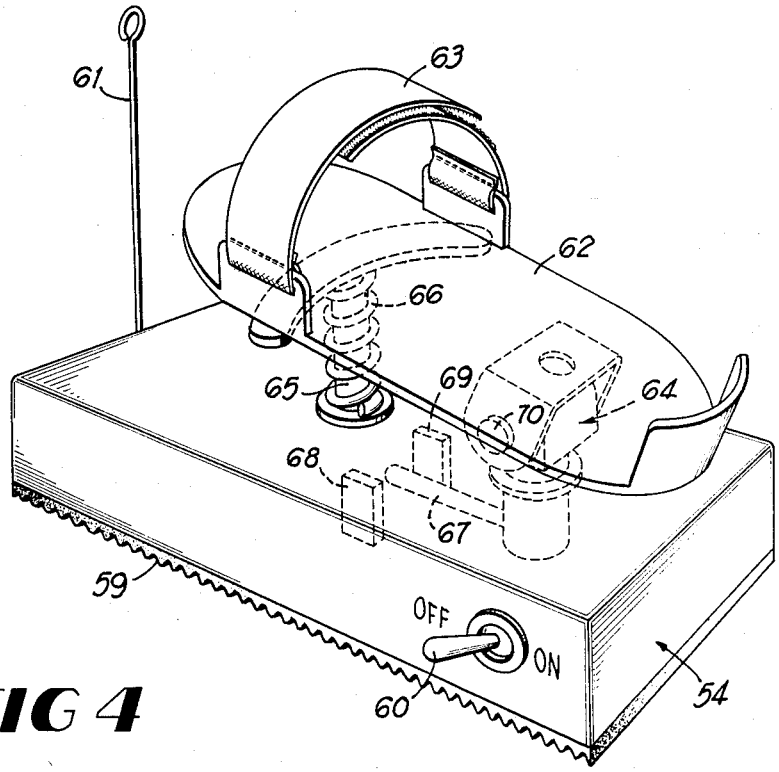
FIG. 4 is a perspective view of a foot-operated transmitter used in a second operational mode.

In either mode of operation, by hand or by foot, remote controlled closing of the trolling motor on-off switch 49 by use of the switch 56 or the foot controlled element 65 causes a 12 volt DC output signal from the receiver 20 to energize relay 48 to close relay switch 49 and deliver power to the trolling motor 10 to turn the propeller 11 in a boat propulsion mode at a slow trolling speed. The trolling motor and propeller will continue to operate in a single directional mode until the relay switch 49 is opened by operation of the switch 56, FIG. 3, or 65, FIG. 4.

For directional control of the trolling motor 10 and the boat on which it is mounted, manipulating the remote control element 57 or the corresponding element 67 of the foot operated transmitter in the direction to cause closing of the left turn switch 40 will cause a 12 volt output signal from the receiver 20 to energize the relay 38, closing relay switch 40 and driving the reversible servo motor 22 counterclockwise. This direction of rotation is imparted through the pinion 24 to the gear 25 which in turn rotates the tubular shaft 12 in a direction whereby the trolling motor 10, being likewise turned in the same direction, will drive the boat to the left in the water.

The described brush and slip ring arrangement allows the shaft 12 to revolve through 360° or more and then stop when the left turn relay switch 40 is opened.

Similarly, utilizing the remote control actuator 57 or 67 to close the right turn switch 41 produces a 12 volt DC signal from the receiver 20 to energize the right turn relay 39, closing the right turn switch 41 to power the turning motor 22 clockwise. The pinion 24 turns the gear 25 and the shaft 12 in the direction whereby the trolling motor 10 will cause the boat to drive or turn to the right. Again, the shaft 12 can rotate through a full 360° or more and the rotation will stop when the right turn switch 41 reopens. It may be noted that the electrical polarity on the turning motor 22 is reversed and consequently the direction of rotation of the turning motor output shaft 23 is reversed when one of the two switches 40 or 41 is closed while the other switch is open to approximately 8 to 10 rpm by the use of a small gear speed reducer built into the motor 22.

When the trolling motor of the steering system is stowed on the boat, the support shaft 12 can be swung upwardly clockwise, in FIG. 1, around the axis of bolt 17. The engagement of the brushes 35 and 36 with the slip rings 29 and 28 is separated and the receiver 20 is turned off.

It is also possible with the invention to add an additional radio channel to the system to move the trolling motor to and from its stowed and active positions by power means rather than by hand. Also, the propulsion speed of the motor 10 could be altered by manual switching or by the addition of a radio channel to provide this feature remotely. A depth finder transducer can also be installed on the bottom of the motor 10, if desired. Electrical connections to this depth finder transducer can be through additional slip rings.

It is to be understood that the form of the invention herewith shown and described is to be taken as a preferred example of the same, and that various changes in the size, shape and arrangement of parts may be resorted to, without departing from the spirit of the invention or scope of the subjoined claims.

I claim:

1. A remote controlled trolling system comprising an electric trolling motor capable of straightaway propulsion and selective direction propulsion, a rotational support shaft carrying the trolling motor, bracket means carrying said support shaft and being adapted for attachment to a boat, a rotational gear fixed on said support shaft to effect rotation of the support shaft with the trolling motor in two directions, electrical slip rings on said rotational gear, a turning servo motor which is reversible and having a drive pinion in mesh with said rotational gear on said support shaft, a radio receiver, right and left turn electrical relays and coacting right and left turn relay switches electrically connected with terminals of said receiver, with terminals of said turning motor and with the electrical slip rings through slip ring brushes, a trolling motor propulsion relay and a coacting trolling motor on-off relay switch electrically connected through switch terminals with the trolling motor and said turning motor, and a remote radio transmitter unit operable with said receiver to selectively energize and de-energize said right and left turn relays and said trolling motor propulsion relay.

2. A remote controlled trolling system as defined in claim 1, and said remote radio transmitter comprising a hand held transmitter having a self-contained power source and an on-off switch.

3. A remote controlled trolling system as defined in claim 1, and said remote radio transmitter comprising a foot operated transmitter having a self-contained power source and an on-off switch.

4. A remote controlled trolling system as defined in claim 2, and the hand held transmitter having a trolling motor on-off control element, and a right turn/left turn control element.

5. A remote controlled trolling system as defined in claim 3, and the foot operated transmitter including a base member, a foot treadle connected through a universal swivel with the base member, a trolling motor on-off control element on the base member and being biased to an off position and moving to an on position in response to depression of the foot treadle, left turn and right turn control elements on the base member, and a left turn/right turn actuator element on said swivel operated in response to horizontal swinging of the foot treadle.

6. A remote controlled trolling system as defined in claim 5, and an anti-skid pad on the bottom face of said base member.

7. A remote controlled trolling system comprising a remote radio transmitter unit, a coacting radio receiver unit, a rotational support shaft, bracket means on said support shaft for attaching it to the stern of a boat, a trolling motor having a propeller on the lower end of the rotational support shaft and being turnable therewith, a turning gear fixed on the support shaft and having slip rings, a reversible electrical servo motor having a drive pinion in mesh with said gear, a DC voltage source connected with said slip rings, contact brushes electrically engaging the slip rings, and control circuitry electrically interconnecting said receiver, trolling motor, servo motor, slip rings and brushes, and said circuitry including a trolling motor on-off relay and relay switch and left turn and right turn relays and relay switches, all of said relays receiving electrical signals from the receiver unit under control of said remote radio transmitter unit.

8. A remote controlled trolling system as defined in claim 7, and a housing for said receiver unit and reversible electrical servo motor.

9. A remote controlled trolling system as defined in claim 8, and said DC voltage source comprising a storage battery, and a pair of battery cables electrically connected with said slip rings and having clips adapted for attachment to terminals of said battery.

10. A remote controlled trolling system as defined in claim 7, and said turning gear having a top surface annular recess containing electrical insulation, and said slip rings comprising a pair of slip rings held on said insulation and having exposed top faces for engagement by said brushes.

11. A remote controlled trolling system as defined in claim 10, and insulated terminal screws electrically connected with said slip rings and extending below the bottom face of said turning gear, and a pair of battery cables electrically connected with said terminal screws below the bottom face of said turning gear and being electrically insulated from the turning gear.

12. A remote controlled drive system for a boat of the type having a bracket for mounting on a boat, a cradle carried by said bracket, a main shaft supported by said cradle, an electric propulsion motor mounted on said main shaft, a propeller driven by said electric propulsion motor, and a power source, the improvement comprising:

a steering motor for rotating said main shaft with respect to said cradle, a radio receiver electrically connected to said steering motor for controlling said steering motor, a rotational gear fixed on said main shaft to effect rotation of the main shaft with the propulsion motor in two directions, electrical slip rings on said rotational gear, said steering motor being reversible and having a drive pinion in mesh with said rotational gear on said main shaft, right and left turn electrical relays and coacting right and left turn relay switches electrically connected with terminals of said radio receiver, with terminals of said steering motor and with the electrical slip rings through slip ring brushes, a propulsion motor relay and a coacting propulsion motor on-off relay switch electrically connected through switch terminals with the propulsion motor and said steering motor, and a remote radio transmitter unit operable with said receiver to selectively energize and de-energize said right and left turn relays and said propulsion motor relay.

13. The remote control drive system defined in claim 12 wherein said power source includes an electric battery for supplying electricity to said propulsion motor and said steering motor, control means for selectively directing electricity from said battery to said steering motor in one direction or the other, said radio receiver being electrically connected to said control means for activating said control means in response to signals from said radio transmitter.

14. The remote control drive system as defined in claim 13 wherein said steering motor is offset from said shaft and parallel thereto, said pinion and gear coacting to rotate said shaft selectively in one direction or the other upon selective rotation of said steering motor.

* * * * *